US010273646B2

(12) United States Patent
Cress

(10) Patent No.: US 10,273,646 B2
(45) Date of Patent: Apr. 30, 2019

(54) GUIDE SYSTEMS AND METHODS FOR DIESEL HAMMERS

(71) Applicant: American Piledriving Equipment, Inc., Kent, WA (US)

(72) Inventor: Steven N. Cress, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 324 days.

(21) Appl. No.: 15/376,446

(22) Filed: Dec. 12, 2016

(65) Prior Publication Data

US 2017/0167104 A1 Jun. 15, 2017

Related U.S. Application Data

(60) Provisional application No. 62/267,048, filed on Dec. 14, 2015.

(51) Int. Cl.
*E02D 7/12* (2006.01)

(52) U.S. Cl.
CPC ..... *E02D 7/125* (2013.01)

(58) Field of Classification Search
CPC ..... E02D 7/125; E02D 7/16; E02D 7/14
USPC .... 173/90, 91, 210, 128, 133; 405/232, 228, 405/256, 253
See application file for complete search history.

(56) References Cited

U.S. PATENT DOCUMENTS

| | | | |
|---|---|---|---|
| 5,015 | A | 3/1847 | Ingalls |
| 48,515 | A | 7/1865 | Campbell et al. |
| 369,176 | A | 8/1887 | Gerstein |
| 400,209 | A | 3/1889 | Haskins |
| 628,962 | A | 7/1899 | Speer |

(Continued)

FOREIGN PATENT DOCUMENTS

| | | | |
|---|---|---|---|
| CN | 2538852 | | 3/2003 |
| CN | 101182714 | A | 5/2008 |

(Continued)

OTHER PUBLICATIONS

USPTO, "Non-Final Office Action, U.S. Appl. No. 15/199,695, p. 218701," dated Sep. 19, 2018, 18 pages.

(Continued)

*Primary Examiner* — Nathaniel C Chukwurah
(74) *Attorney, Agent, or Firm* — Michael R. Schacht; Schacht Law Office, Inc.

(57) ABSTRACT

A guide system for allowing a diesel hammer to be supported by a plurality of support systems comprises a primary channel system and a pair of first and second channel adapter assemblies. The primary channel system rigidly connected to the diesel hammer to define a pair of primary channels and a primary spacing distance. Each first channel adapter assembly defines a first secondary channel. The guide system operates in a first configuration and a second configuration. In the second configuration, each of the first channel adapter assemblies is detachably attached to the primary channel system such that the first channel adapter assemblies define a first secondary spacing distance between the first secondary channels, the first secondary spacing distance is different from the primary spacing distance, and portions of a second support system of the plurality of support systems are received within the first secondary channels.

16 Claims, 12 Drawing Sheets

(56) References Cited

U.S. PATENT DOCUMENTS 999,334 A 8/1911 Pearson
1,128,808 A 2/1915 Manoogian
1,213,800 A 1/1917 Piper
1,288,989 A 12/1918 Rees
1,294,154 A 2/1919 Payne
1,322,470 A 11/1919 Schenk
1,348,994 A 8/1920 Heckle
1,464,231 A 8/1923 Yezek
1,654,093 A 12/1927 Reid
1,702,349 A 2/1929 Krell
1,748,555 A 2/1930 Kinney
1,762,037 A 6/1930 Taylor
1,769,169 A 7/1930 Thornley
1,787,000 A 12/1930 Hunt
1,903,555 A 4/1933 Robertson
1,914,899 A 6/1933 Syme
1,988,173 A 1/1935 Kersting
2,068,045 A 1/1937 Wohlmeyer
2,239,024 A 4/1941 Vance
2,577,252 A 12/1951 Kjellman
2,723,532 A 11/1955 Smith
2,755,783 A 7/1956 Kupka
2,804,856 A 9/1957 Spurlin
2,842,972 A 7/1958 Houdart
2,859,628 A 11/1958 Arko
2,882,690 A * 4/1959 Frederick ..... E02D 7/125 173/124
2,904,964 A 9/1959 Kupka
2,952,132 A 9/1960 Urban
3,001,515 A 9/1961 Haage
3,004,389 A 10/1961 Muller
3,034,304 A 5/1962 Upson
3,094,007 A 6/1963 Luhrs
3,100,382 A 8/1963 Muller
3,101,552 A 8/1963 Tandler
3,106,258 A 10/1963 Muller
3,108,503 A * 10/1963 Murek ..... B21J 7/24 72/427
3,115,198 A 12/1963 Kuss
3,149,851 A 9/1964 Adams
3,172,485 A 3/1965 Spannhake et al.
3,177,029 A 4/1965 Larson
3,193,026 A 7/1965 Kupka
3,227,483 A 1/1966 Guild et al.
3,243,190 A 3/1966 Peregrine
3,267,677 A 8/1966 Bollar
3,289,774 A 12/1966 Bodine, Jr.
3,300,987 A 1/1967 Maeda
3,313,376 A 4/1967 Holland
3,371,727 A 3/1968 Belousov et al.
3,381,422 A 5/1968 Olson
3,391,435 A 7/1968 Lebelle
3,394,766 A 7/1968 Lebelle
3,412,813 A 11/1968 Johnson
3,447,423 A 6/1969 Henry
3,450,398 A 6/1969 Barnes
3,460,637 A 8/1969 Schulin
3,513,587 A 5/1970 Artur
3,530,947 A 9/1970 Gendron
3,577,645 A 5/1971 Zurawski
3,583,497 A 6/1971 Kossowski et al.
3,616,453 A 10/1971 Philpot
3,620,137 A 11/1971 Prasse
3,638,738 A 2/1972 Varnell
3,679,005 A 7/1972 Inaba et al.
3,684,037 A 8/1972 Bodine
3,686,877 A 8/1972 Bodin
3,711,161 A 1/1973 Proctor et al.
3,720,435 A 3/1973 Leyn
3,734,209 A 5/1973 Haisch et al.
3,786,874 A 1/1974 Demichelis et al.
3,789,930 A 2/1974 Nishimura et al.
3,797,585 A 3/1974 Ludvigson
3,822,969 A 7/1974 Kummel
3,828,864 A 8/1974 Haverkamp et al.
3,854,418 A 12/1974 Bertin
3,861,664 A 1/1975 Durkee
3,865,501 A 2/1975 Kniep
3,871,617 A 3/1975 Majima
3,874,244 A 4/1975 Rasmussen et al.
3,891,186 A 6/1975 Thorsell
3,907,042 A 9/1975 Halwas et al.
3,952,796 A 4/1976 Larson
3,959,557 A 5/1976 Berry
3,967,688 A 7/1976 Inenaga et al.
3,975,918 A 8/1976 Jansz
3,991,833 A 11/1976 Ruppert
3,998,063 A 12/1976 Harders
4,018,290 A 4/1977 Schmidt
4,029,158 A 6/1977 Gerrish
4,033,419 A 7/1977 Pennington
4,067,369 A 1/1978 Harmon
4,076,081 A * 2/1978 Schnell ..... E02D 7/125 173/137
4,082,361 A 4/1978 Lanfermann
4,099,387 A 7/1978 Frederick et al.
4,100,974 A 7/1978 Pepe
4,102,408 A 7/1978 Ludvigson
4,109,475 A 8/1978 Schnell
4,113,034 A 9/1978 Carlson
4,119,159 A 10/1978 Arentsen
4,143,985 A 3/1979 Axelsson et al.
4,154,307 A 5/1979 Gendron et al.
4,155,600 A 5/1979 Lanfermann et al.
4,166,508 A 9/1979 van den Berg
4,180,047 A 12/1979 Bertelson
4,187,917 A 2/1980 Bouyoucos
4,195,698 A 4/1980 Nakagawasai
4,248,550 A 2/1981 Blaschke et al.
4,262,755 A 4/1981 Kuhn
4,274,761 A 6/1981 Boguth
4,312,413 A 1/1982 Loftis
4,362,216 A 12/1982 Jansz
4,366,870 A 1/1983 Frederick
4,367,800 A 1/1983 Arentsen
4,375,927 A 3/1983 Kniep
4,380,918 A 4/1983 Killop
4,382,475 A 5/1983 Suzuki
4,397,199 A 8/1983 Jahn
4,421,180 A 12/1983 Fleishman et al.
4,428,699 A 1/1984 Juhola
4,430,024 A 2/1984 Guild et al.
4,436,452 A 3/1984 Bodine
4,455,105 A 6/1984 Juhola
4,465,145 A 8/1984 Kuhn
4,473,123 A 9/1984 Ranft et al.
4,497,376 A 2/1985 Kurylko
4,505,614 A 3/1985 Anschutz
4,519,729 A 5/1985 Clarke et al.
4,537,527 A 8/1985 Juhola et al.
4,547,110 A 10/1985 Davidson
4,553,443 A 11/1985 Rossfelder et al.
4,601,615 A 7/1986 Cavalli
4,603,748 A 8/1986 Rossfelder et al.
4,624,325 A 11/1986 Steiner
4,626,138 A * 12/1986 Boyes ..... E02D 7/20 254/29 R
4,627,768 A 12/1986 Thomas et al.
4,632,602 A 12/1986 Hovnanian
4,637,475 A 1/1987 England et al.
4,645,017 A 2/1987 Bodine
4,687,026 A 8/1987 Westman
4,725,167 A 2/1988 Merjan
4,735,270 A 4/1988 Fenyvesi
4,755,080 A 7/1988 Cortlever et al.
4,757,809 A 7/1988 Koeneman et al.
4,758,148 A 7/1988 Jidell
4,768,900 A 9/1988 Burland
4,799,557 A 1/1989 Jacquemet
4,813,814 A 3/1989 Shibuta et al.
4,844,661 A 7/1989 Martin et al.
4,863,312 A 9/1989 Cavalli
4,915,180 A 4/1990 Schisler
4,961,471 A 10/1990 Ovens

(56) References Cited

U.S. PATENT DOCUMENTS

| | | | |
|---|---|---|---|
| 4,974,997 | A | 12/1990 | Sero et al. |
| 4,989,677 | A | 2/1991 | Lam |
| 4,993,500 | A | 2/1991 | Greene et al. |
| 5,004,055 | A | 4/1991 | Porritt et al. |
| 5,018,251 | A | 5/1991 | Brown |
| 5,076,090 | A | 12/1991 | Cetnarowski |
| 5,088,565 | A | 2/1992 | Evarts |
| 5,107,934 | A | 4/1992 | Atchison |
| 5,117,925 | A | 6/1992 | White |
| 5,154,667 | A | 10/1992 | Mauch et al. |
| 5,161,625 | A | 11/1992 | Seng |
| 5,213,449 | A | 5/1993 | Morris |
| 5,253,542 | A | 10/1993 | Houze |
| RE34,460 | E | 11/1993 | Ishiguro et al. |
| 5,263,544 | A | 11/1993 | White |
| 5,281,775 | A | 1/1994 | Gremillion |
| 5,343,002 | A | 8/1994 | Gremillion |
| 5,355,964 | A | 10/1994 | White |
| 5,375,897 | A | 12/1994 | Gazel-Anthoine |
| 5,385,218 | A | 1/1995 | Migliori |
| 5,409,070 | A | 4/1995 | Roussy |
| 5,410,879 | A | 5/1995 | Houze |
| 5,423,633 | A | 6/1995 | Verstraeten |
| 5,439,326 | A | 8/1995 | Goughnour et al. |
| 5,526,885 | A | 6/1996 | Kuvshinov et al. |
| 5,529,132 | A | 6/1996 | Evarts |
| 5,540,193 | A | 7/1996 | Achten et al. |
| 5,540,295 | A | 7/1996 | Serrette |
| 5,544,979 | A | 8/1996 | White |
| 5,549,168 | A | 8/1996 | Sadler et al. |
| 5,551,804 | A | 9/1996 | Breaux et al. |
| 5,562,169 | A | 10/1996 | Barrow |
| 5,609,380 | A | 3/1997 | White |
| 5,653,556 | A | 8/1997 | White |
| 5,658,091 | A | 8/1997 | Goughnour et al. |
| 5,727,639 | A | 3/1998 | Jeter |
| 5,788,419 | A | 8/1998 | Whitty, Jr. et al. |
| 5,794,716 | A | 8/1998 | White |
| 5,806,610 | A | 9/1998 | Sapozhnikov |
| 5,811,741 | A | 9/1998 | Coast et al. |
| 5,836,205 | A | 11/1998 | Meyer |
| 5,860,482 | A | 1/1999 | Gremillion et al. |
| 5,918,511 | A | 7/1999 | Sabbaghian et al. |
| 5,924,498 | A | 7/1999 | Nilsen |
| 5,934,835 | A | 8/1999 | Whitty, Jr. et al. |
| 6,003,619 | A | 12/1999 | Lange |
| 6,039,508 | A | 3/2000 | White |
| 6,056,070 | A | 5/2000 | Shinohara et al. |
| 6,102,133 | A | 8/2000 | Scheid et al. |
| 6,129,159 | A | 10/2000 | Scott et al. |
| 6,129,487 | A | 10/2000 | Bermingham et al. |
| 6,135,214 | A | 10/2000 | Last |
| 6,155,353 | A | 12/2000 | Ottestad |
| 6,179,527 | B1 | 1/2001 | Goughnour |
| 6,186,043 | B1 | 2/2001 | Callies |
| 6,216,394 | B1 | 4/2001 | Fenelon |
| 6,224,294 | B1 | 5/2001 | Mansfield |
| 6,227,767 | B1 | 5/2001 | Mosing et al. |
| 6,234,260 | B1 | 5/2001 | Coast et al. |
| 6,250,426 | B1 | 6/2001 | Lombard |
| 6,360,829 | B1 | 3/2002 | Naber et al. |
| 6,364,577 | B1 | 4/2002 | Haney |
| 6,378,951 | B1 | 4/2002 | Bouyoucos et al. |
| 6,386,295 | B1 | 5/2002 | Suver |
| 6,427,402 | B1 | 8/2002 | White |
| 6,431,795 | B2 | 8/2002 | White |
| 6,447,036 | B1 | 9/2002 | White |
| 6,484,553 | B1 | 11/2002 | Devers |
| 6,543,966 | B2 | 4/2003 | White |
| 6,557,647 | B2 | 5/2003 | White |
| 6,582,158 | B1 | 6/2003 | Van Stein |
| 6,648,556 | B1 | 11/2003 | White |
| 6,652,194 | B2 | 11/2003 | Ingle |
| 6,672,805 | B1 | 1/2004 | White |
| 6,691,797 | B1 | 2/2004 | Hart |
| 6,732,483 | B1 | 5/2004 | White |
| 6,736,218 | B1 | 5/2004 | White |
| 6,752,043 | B2 | 6/2004 | Carlson |
| 6,860,338 | B2 | 3/2005 | Salesse et al. |
| 6,896,448 | B1 | 5/2005 | White |
| 6,908,262 | B1 | 6/2005 | White |
| 6,942,430 | B1 | 9/2005 | Suver |
| 6,988,564 | B2 | 1/2006 | White |
| 7,043,806 | B2 | 5/2006 | Schrock et al. |
| 7,168,890 | B1 | 1/2007 | Evarts |
| 7,392,855 | B1 | 7/2008 | White |
| 7,404,449 | B2 | 7/2008 | Bermingham et al. |
| 7,407,343 | B2 | 8/2008 | van Halteren et al. |
| 7,591,612 | B2 | 9/2009 | Wong |
| 7,694,747 | B1 | 4/2010 | White |
| 7,708,499 | B1 | 5/2010 | Evarts et al. |
| 7,726,913 | B1 | 6/2010 | Sjogren |
| 7,824,132 | B1 | 11/2010 | White |
| 7,854,571 | B1 | 12/2010 | Evarts |
| 7,950,877 | B2 | 5/2011 | Evarts |
| 7,972,083 | B2 | 7/2011 | Jones |
| 8,070,391 | B2 | 12/2011 | White |
| 8,181,713 | B2 | 5/2012 | White |
| 8,186,452 | B1 | 5/2012 | White et al. |
| 8,763,719 | B2 | 7/2014 | White |
| 2002/0139550 | A1 | 10/2002 | Mewes |
| 2003/0143036 | A1 | 7/2003 | Larsen, Jr. |
| 2005/0013675 | A1 | 1/2005 | Bengston et al. |
| 2005/0232708 | A1 | 10/2005 | White |
| 2006/0052818 | A1 | 3/2006 | Drake et al. |
| 2006/0113456 | A1 | 6/2006 | Miller |
| 2006/0216118 | A1 | 9/2006 | Wong |
| 2008/0310923 | A1 | 12/2008 | Jinnings et al. |
| 2009/0129870 | A1 | 5/2009 | Jones |
| 2010/0303552 | A1 | 12/2010 | Yingling et al. |
| 2011/0162859 | A1 | 7/2011 | White |
| 2011/0243668 | A1 | 10/2011 | White |
| 2011/0252610 | A1 | 10/2011 | Evarts |
| 2012/0114424 | A1 | 5/2012 | White |
| 2014/0231115 | A1 | 8/2014 | Heichel |
| 2018/0002886 | A1 | 1/2018 | Cress et al. |

FOREIGN PATENT DOCUMENTS

| | | | |
|---|---|---|---|
| CN | 107558472 | A | 1/2018 |
| DE | 4010357 | A1 | 10/1990 |
| DE | 4414190 | C1 | 7/1995 |
| DE | 102006053482 | | 6/2008 |
| EP | 0172960 | | 5/1986 |
| EP | 362158 | | 4/1990 |
| EP | 526743 | | 10/1993 |
| FR | 838717 | | 3/1939 |
| FR | 2560247 | | 8/1985 |
| GB | 1066727 | | 4/1967 |
| GB | 2003769 | | 3/1979 |
| GB | 2023496 | | 1/1980 |
| GB | 2028902 | | 3/1980 |
| GB | 2043755 | | 10/1980 |
| GB | 2060742 | | 5/1981 |
| JP | 5494703 | | 7/1979 |
| JP | 355098526 | | 7/1980 |
| JP | 356034828 | | 4/1981 |
| JP | 57169130 | | 10/1982 |
| JP | 59228529 | A | 12/1984 |
| JP | 61221416 | | 10/1986 |
| JP | 0258627 | | 2/1990 |
| JP | 497015 | A | 3/1992 |
| JP | 473035 | | 6/1992 |
| JP | 5246681 | | 9/1993 |
| JP | 6136751 | | 5/1994 |
| JP | 9328983 | A | 12/1997 |
| KR | 1020010044658 | A | 5/2001 |
| KR | 1020030017742 | A | 4/2003 |
| NL | 42349 | | 1/1938 |
| NL | 65252 | | 2/1950 |
| NL | 7710385 | | 3/1978 |
| NL | 7707303 | | 1/1979 |
| NL | 7805153 | | 11/1979 |
| NO | 46428 | | 4/1929 |

(56) References Cited

FOREIGN PATENT DOCUMENTS

| | | |
|---|---|---|
| SU | 1027357 | 7/1983 |
| WO | 8707673 | 12/1987 |
| WO | 8805843 | 8/1988 |

OTHER PUBLICATIONS

"Kony Drain Board," undated, 1 page.
"The 1st Report on the Treatment of Soft Foundation in Juck Hyun Industrial Site", Ref. Nos. APE00854-APE00856, 1976, 3 pages.
American Piledriving Equipment, Inc., A series of photographs identified by Reference Nos. APE01147-APE01159, undated, 13 pages.
APE, "APE Model 8 Hydraulic Impact Hammer," 2000, 1 page.
CCPIT Patent and Trademark Law Office, Office Action and Search Report, Application No. 201210346475.7, Apr. 27, 2015, 15 pages.
International Construction Equipment, Inc., "Diesel Pile Hammers" brochure, Ref. No. DH4-1288-5C, undated, 6 pages.
International Construction Equipment, Inc., "Hydraulic Vibratory Driver/Extractors for Piling and Caisson Work," Ref. No. V7-0890-51, undated, 3 pages.
International Construction Equipment, Inc., "Hydraulic Vibratory Driver/Extractors for Piling and Caisson Work," undated, 10 pages.
International Searching Authority, "International Search Report", dated Jan. 28, 2011, 11 pages.
Japan Development Consultants, INC., "Castle Board Drain Method" Japanese language brochure, Ref. Nos. APE00857-APE00863, Aug. 1976, 6 pages.
Korean language documents identified by Ref. Nos. APE00864-APE00891, dates from 1982-1997, 28 pages.
MKT Corporation, "Operating, Maintenance and Parts Manual for MS350 and MS500 Single-Acting Pile Hammers," 12 pages.
MKT Geotechnical Systems, Manual No. 01807: "Operating, Maintenance and Parts manual for MS350 and MS500 Single-Acting Pile Hammers," undated, 12 pages.
Report identifying systems for driving mandrels carrying wick drain material into the earth, Ref. Nos. APE0510-APE0536, undated, 27 pages.
Schematic drawings, Ref. Nos. APE01038, APE01039, APE0339, undated, 2 pages.
Shanghai Jintai SEMW, undated, 8 pages.
www.mmsonline.com/columns/micro-keying-keeps-a-better-grip.aspx, Seibert, Stan, Modern Machine Shop: "Micro-Keying Keeps a Better Grip," Aug. 1, 1992, 2 pages.

* cited by examiner

GUIDE SYSTEMS AND METHODS FOR DIESEL HAMMERS

RELATED APPLICATIONS

This application U.S. patent application Ser. No. 15/376,446 filed Dec. 12, 2016 claims benefit of U.S. Provisional Application Ser. No. 62/267,048 filed Dec. 14, 2015, now expired, the contents of which are incorporated herein by reference.

TECHNICAL FIELD

The present invention relates to diesel hammers for pile driving and, in particular, to guide systems and methods that simplify the process of adapting a diesel hammer to different support structures having different geometries.

BACKGROUND

A diesel hammer is a pile driver having a housing and a ram. The ram is forced up by diesel combustion and falls within the housing to impact a pile and drive the pile into the earth. Conventionally, a support system supports the diesel hammer above the pile as the ram is driving the pile such that the driving force is applied along the axis of the pile. As the diesel hammer drives the pile, the support system interacts with a guide system that guides the diesel hammer such that a housing thereof moves with the pile along the pile axis.

Support systems for the diesel hammer come in a variety of configurations. Conventionally, the guide system for the diesel hammer is modified to adapt to a particular diesel hammer to a particular configuration of support system.

The need exists for a guide systems and methods for diesel hammers that may be easily reconfigured to allow a particular support system to accommodate a particular diesel hammer.

SUMMARY

The present invention may be embodied as a guide system for allowing a diesel hammer to be supported by a plurality of support systems comprising a primary channel system and a pair of first channel adapter assemblies. The primary channel system is rigidly connected to the diesel hammer to define a pair of primary channels and a primary spacing distance between the primary channels. Each of the pair of first channel adapter assemblies defines a first secondary channel. The guide system operates in a first configuration and in a second configuration. In the first configuration, portions of a first support system of the plurality of support systems are received within the primary channels. In the second configuration, each of the first channel adapter assemblies is detachably attached to the primary channel system such that the first channel adapter assemblies define a first secondary spacing distance between the first secondary channels, the first secondary spacing distance is different from the primary spacing distance, and portions of a second support system of the plurality of support systems are received within the first secondary channels.

The present invention may also be embodied as a method of supporting a diesel hammer from a plurality of support systems comprising the following steps. A primary channel system is rigidly connected to the diesel hammer to define a pair of primary channels and a primary spacing distance between the primary channels. A pair of first channel adapter assemblies is provided, and each first channel adapter assembly defines a first secondary channel. In a first configuration, portions of a first support system of the plurality of support systems are received within the primary channels. In a second configuration, each of the first channel adapter assemblies is detachably attached to the primary channel system such that the first channel adapter assemblies define a first secondary spacing distance between the first secondary channels, the first secondary spacing distance is different from the primary spacing distance, and portions of a second support system of the plurality of support systems are received within the first secondary channels.

The present invention may also be embodied as a guide system for allowing a diesel hammer to be supported by first, second, and third support systems. The guide system comprises a primary channel system, a pair of first channel adapter assemblies, and a pair of second channel adapter assemblies. The primary channel system is rigidly connected to the diesel hammer to define a pair of primary channels and a primary spacing distance between the primary channels. Each of the first channel adapter assemblies defines first secondary channel. Each of the second channel adapter assemblies defines a second secondary channel. The guide system operates in first, second, and third configuration. In the first configuration, portions of the first support system are received within the primary channels. In the second configuration, each of the first secondary channel adapter assemblies is detachably attached to the primary channel system such that the first channel adapter assemblies define a first secondary spacing distance between the first secondary channels, the first secondary spacing distance is different from the primary spacing distance, and portions of the second support system are received within the first secondary channels. In the third configuration, each of the second channel adapter assemblies is detachably attached to the primary channel system such that the second channel adapter assemblies define a second secondary spacing distance between the first secondary channels, the second secondary spacing distance is different from the primary spacing distance and the first secondary spacing distance, and portions of the third support system are received within the second secondary channels.

DETAILED DESCRIPTION

Figure 1:
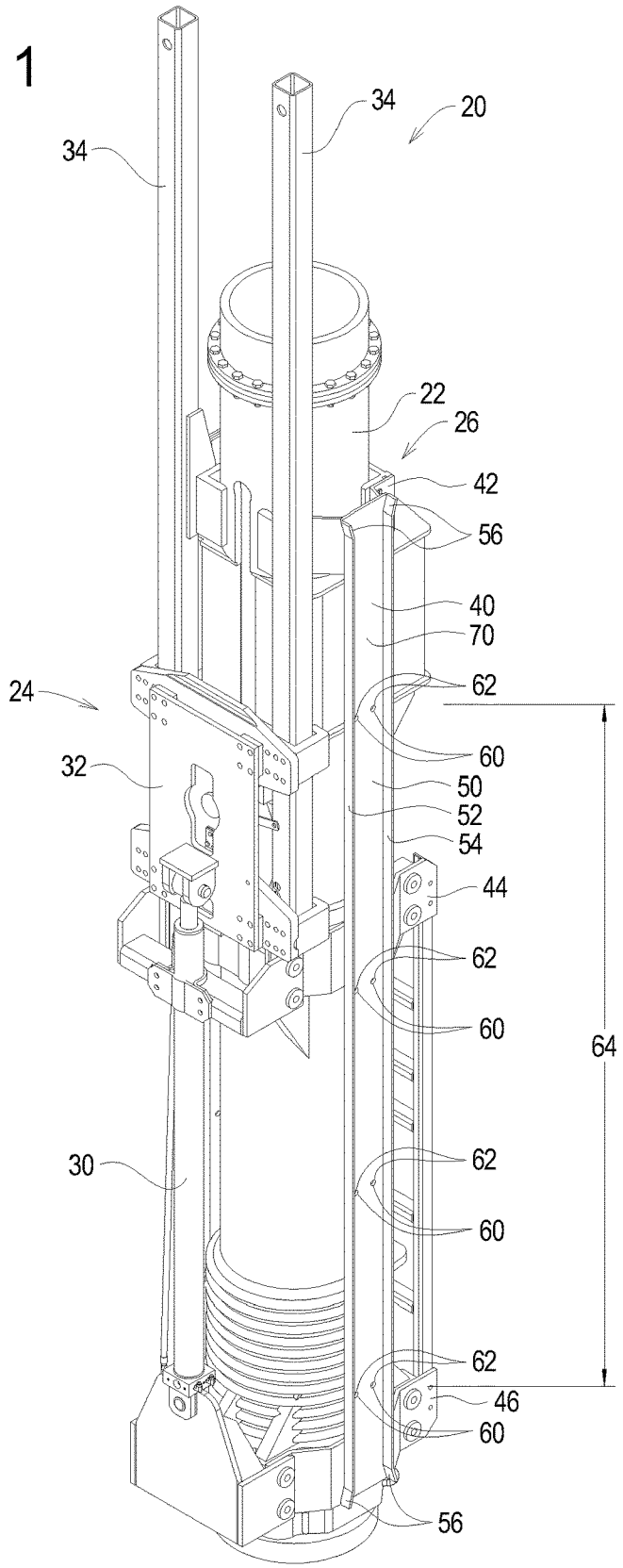
FIG. 1 is a perspective view of a first example configuration of a first example diesel hammer system of the present invention.
Figure 2:
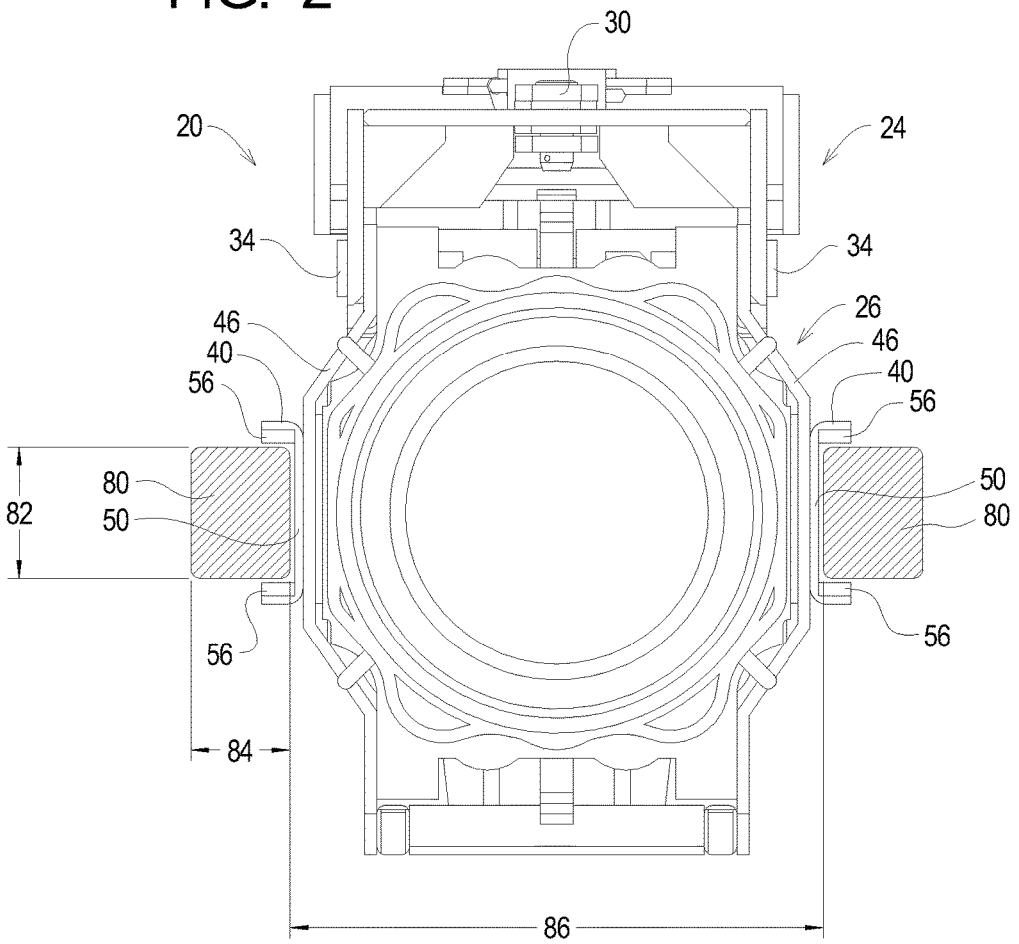
FIG. 2 is a bottom plan view of the first example diesel hammer in the first configuration.
Figure 3:
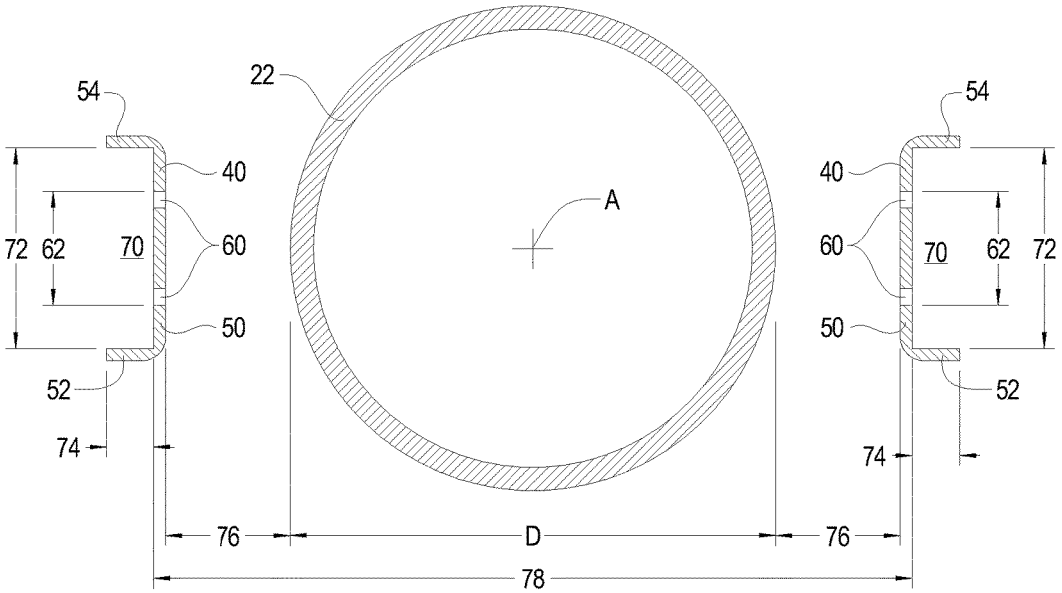
FIG. 3 is a somewhat schematic section view of the first example diesel hammer in the first configuration.
Figure 4:
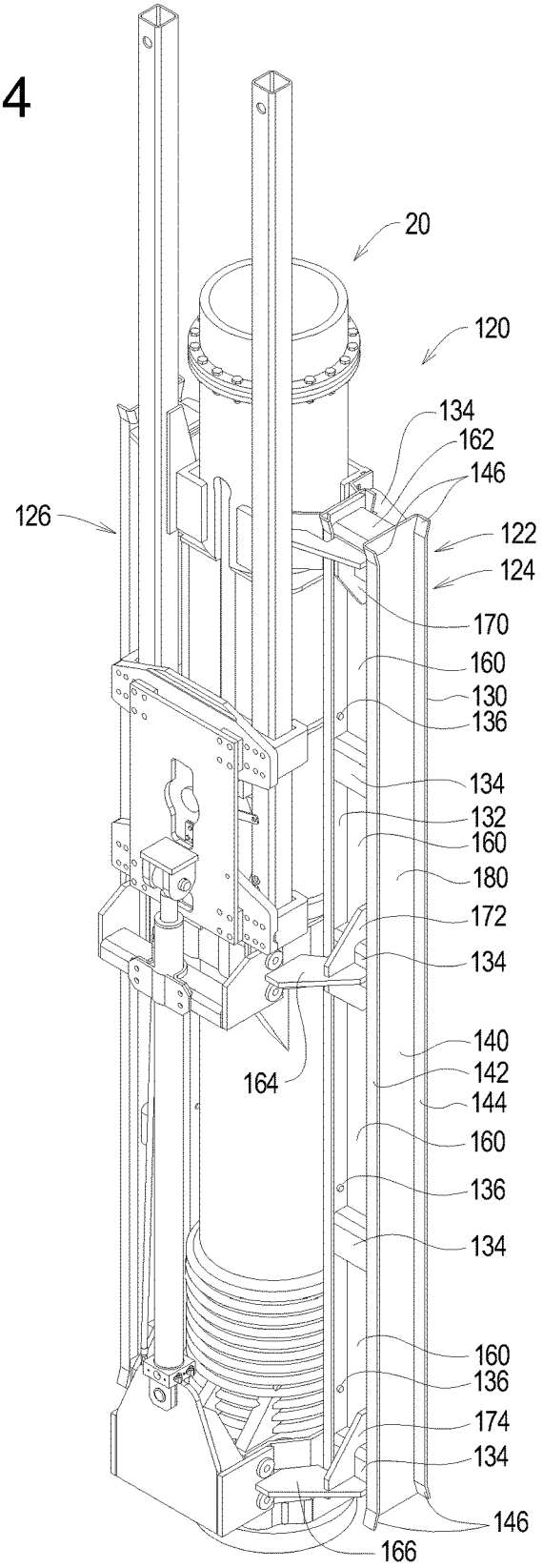
FIG. 4 is a perspective view of a second example diesel hammer system of the present invention.

Referring initially to FIG. 1 of the drawings, depicted therein is a first example diesel hammer system 20 constructed in accordance with, and embodying, the principles of the present invention. The example diesel hammer assembly 20 is shown in FIGS. 1-3 in a first configuration. The first example diesel hammer system 20 comprises a ram housing 22, a ram displacement system 24, and a primary channel system 26. The ram displacement system 24 comprises an actuator 30, a carriage 32, and carriage rails 34. The ram housing 22 and ram displacement system 24 are or may be conventional and will be described herein only to that extent necessary for a complete understanding of the present invention.

A ram (not shown) is supported for up and down movement within the housing 22 during operation of the diesel hammer 20 to drive a pile (not shown). The primary channel system 26 is configured to allow the ram housing 22 to be held in an upright position during pile driving operation but also to allow the ram housing 22 to move down relative to the earth as the pile is driven into the earth.

The example primary channel system 26 comprises a pair of primary guide members 40. The example primary guide members 40 are secured to the ram housing 22 by first mounting brackets 42, second mounting brackets 44, and third mounting brackets 46. During normal use of the example pile driving system 20, the first, second, and third mounting brackets 42, 44, and 46 will be connected to an upper end, a middle portion, and a lower end of the ram housing 22, respectively. Typically, the primary guide members 40 are rigidly connected to the mounting brackets 42, 44, and 46 by welding or the like, while the mounting brackets 42, 44, and 46 are rigidly connected to the ram housing 22 by welding or the like.

The example primary channel system 26 comprises two identical guide members 40, and the guide members 40 and mounting brackets 42, 44, and 46 are symmetrically arranged on opposite sides of the ram housing 22. However, more than two guide members and/or guide members of different dimensions may be used as part of a support system of the present invention.

Each of the example guide members 40 comprises a main guide wall 50, a first side guide wall 52, a second side guide wall 54, and flared surfaces 56 formed on both ends of the side guide walls 52 and 54. Primary mounting holes 60 are formed in the main guide walls 50. The example primary mounting holes 60 are arranged in pairs 62, and the pairs 62 are grouped to define a primary hole pattern 64. The primary channel members 40 define primary channels 70 between the guide walls 50, 52, and 54. Each of the primary channels 70 defines a primary channel width 72 and a primary channel depth 74.

As perhaps best shown in FIG. 3, the example mounting brackets 42, 44, and 46 support the primary channel members 40 such that reference planes defined by the guide walls 50, 52, and 54 are parallel to a longitudinal ram axis A of the ram housing 22. Further, the mounting brackets 42, 44, and 46 support the primary channel members 40 such that the main guide walls 50 of each of the example guide members 40 are spaced the same distance from the ram axis A and thus each define a primary offset distance 76 indicating a distance between the primary channel members 40 and a closest portion of the outer surface of the ram housing 22. The primary channel members 40 further define a primary channel spacing distance 78 between the primary channels 70.

FIG. 2 illustrates that a first support member 80 is arranged at least partly within each of the primary channels 70. The first support members 80 are identical and define a substantially rectangular cross-sectional shape as shown in FIG. 2. The support members 80 are rigid members that are supported in parallel relative to each other; the support members 80 may be made of solid material but are more likely made of hollow rectangular tubing. In any event, the first support members 80 define a first support width 82 and a first support depth 84. Further, the first support members 80 are spaced from each other by a first support spacing distance 86.

The first support width 82, first support depth 84, and first support spacing distance 86 will be predetermined for a particular situation. The first support width 82 will determine the primary channel width 72, the first support depth 84 will determine the primary channel depth 74, and the first support spacing distance 86 will determine the primary channel spacing distance 78. In particular, the primary channel width 72 will be slightly larger than the first support width 82, the primary channel depth 74 will be sufficient to engage the first support depth 84 dimensions of the support members 80 to allow the support members 80 to engage the primary channel members 40 to hold the diesel hammer system 20 substantially upright or vertical, and the primary channel spacing distance 78 will be slightly smaller than the first support spacing distance 86.

In use, the support members 80 are sized, dimensioned, and arranged to maintain the diesel hammer system 20 in a substantially upright or vertical orientation during normal operation of the diesel hammer system 20. In particular, the support members 80 will typically be held by a vehicle or crane (not shown) capable of supporting the support members 80 and diesel hammer system 20 in a substantially upright or vertical orientation relative to a desired location at which the pile is to be driven. The vehicle or crane for supporting the support members 80 is or may be conventional and will not be described herein in detail.

Turning now to FIGS. 4-9 illustrate a second diesel hammer system 120 comprising the example diesel hammer system 20 arranged in a second configuration with a first example channel adapter system 122. The first example channel adapter system 122 comprises a first channel adapter assembly 124 and a second channel adapter system 126. The first and second channel adapter assemblies 124 and 126 are identical.

In particular, each of the example first and second channel adapter assemblies 124 and 126 comprises a secondary channel member 130, a base member 132, one or more standoff members 134, and at least one bolt assembly 136. The example secondary channel members 130 are identical and each comprises a main guide wall 140, a first side guide wall 142, a second side guide wall 144, and flared surfaces 146 formed on each end of the first and second side guide walls 142 and 144. Secondary mounting holes 150 are formed in the main guide walls 140. The mounting holes 150 are arranged in pairs 152, and the pairs 152 are grouped to define a first secondary hole pattern 154. The example bolt assembly or assemblies 136 each comprises a bolt 156 and a nut 158. The example standoff members 134 rigidly connect the secondary channel member 130 to the base member 132 such that the main guide wall 140 is substantially parallel to a reference plane defined by the base member 132.

The example first and second channel adapter assemblies 124 and 126 further comprise web members 160, first lateral braces 162, second lateral braces 164, third lateral braces 166, first longitudinal braces 170, second longitudinal braces 172, and third longitudinal braces 174. Each web member 160 is rigidly connected to the base member 132 and one or more of the standoff members 134. The example lateral braces 162, 164, and 166 are each rigidly connected to one of the standoff members 134 and the secondary channel member 130. The example longitudinal braces 170, 172, and 174 are rigidly connected to one of the standoff members 134, one of the web members 160, and one of the lateral braces 162, 164, or 166.

Figure 8:
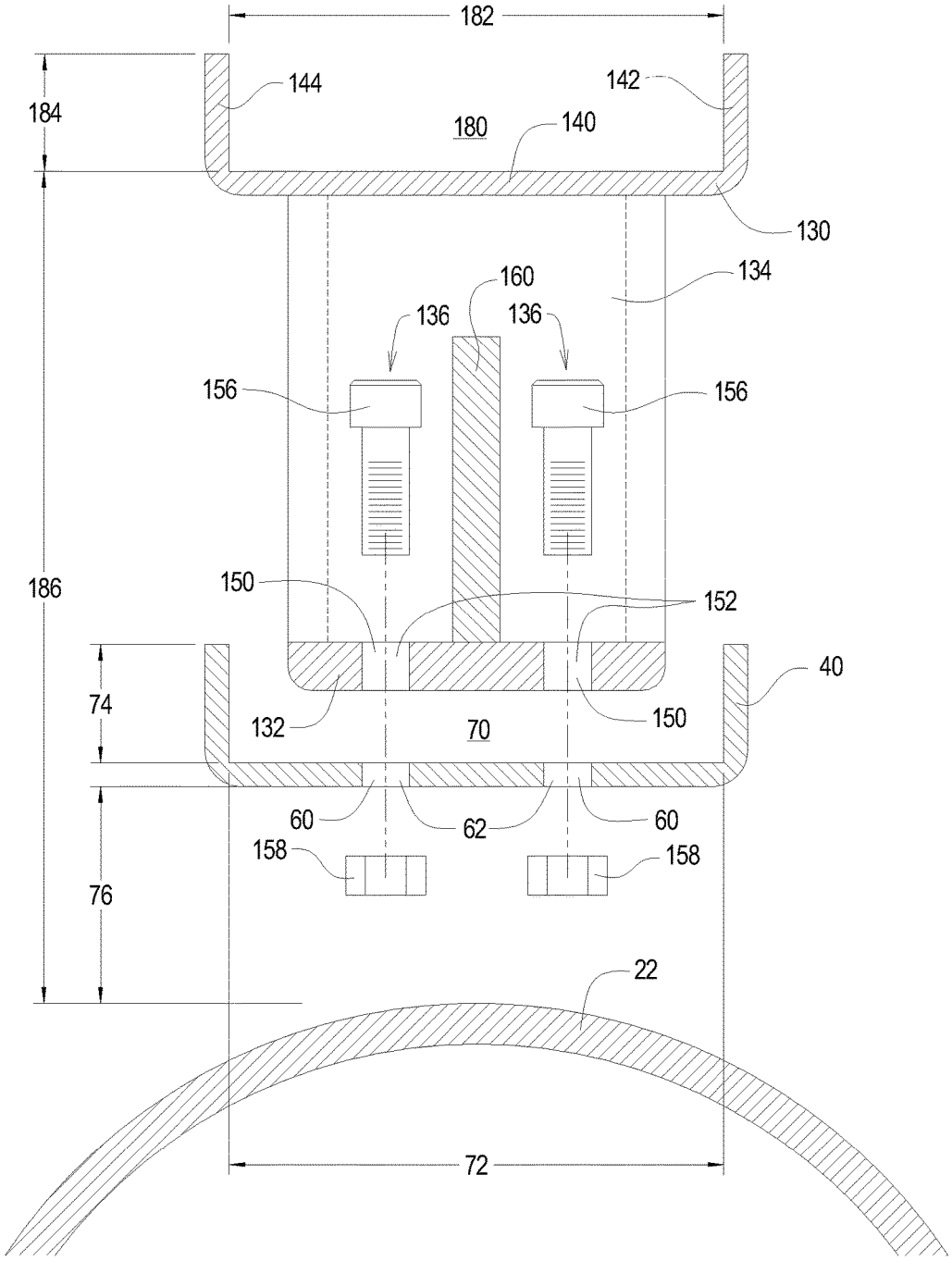
FIG. 8 is a somewhat schematic exploded section view of a portion of the second example diesel hammer.
Figure 9:
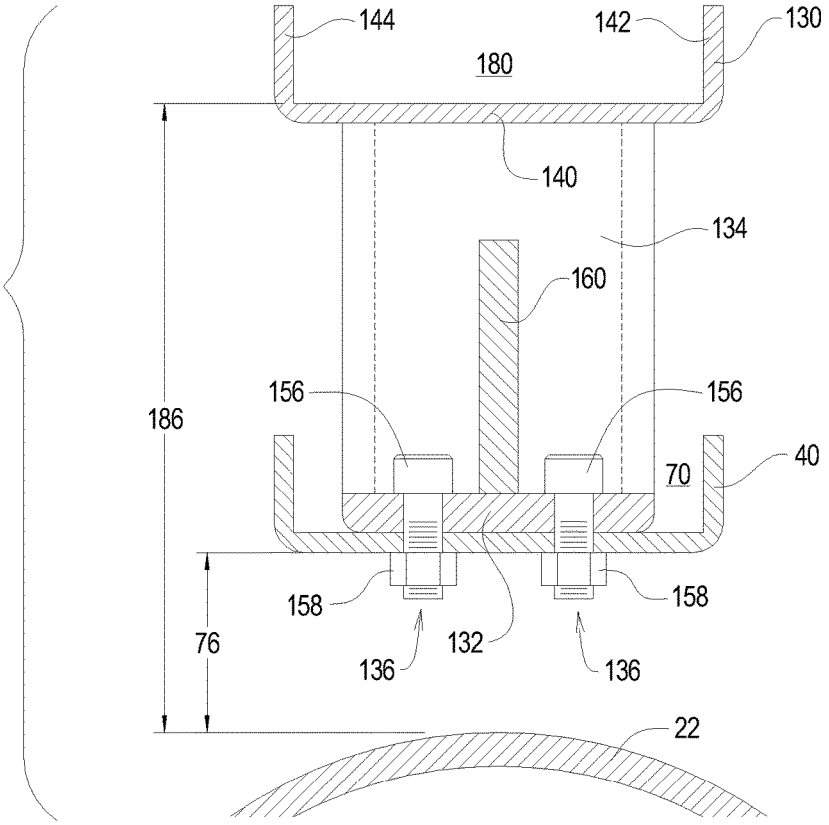
FIG. 9 is a somewhat schematic section view of a portion of the second example diesel hammer.

As shown in FIG. 8, the secondary channel members 130 define secondary channel 180 defining a secondary channel width 182 and a secondary channel depth 184.

To form the second diesel hammer system 120, the first and second channel adapter assemblies 124 and 126 are arranged such that the base members 132 thereof are each within one of the primary channels 70 with the secondary mounting holes 150 aligned with the primary mounting holes 60. In particular, the primary hole pattern 64 and secondary hole pattern 154 are sufficiently similar such that the bolts 156 may be inserted through the aligned holes 60 and 150. Rotating the nuts 158 relative to the bolts 156 allows the bolt assemblies 136 to be formed, thereby rigidly connecting the base members 132, and thus the first and second adapter assemblies 124 and 126, to the diesel hammer system 20.

Further, the primary hole pattern 64 and secondary hole pattern 154 are configured such that, when the first and second adapter assemblies 124 and 126 are rigidly connected to the diesel hammer system 20, the secondary channels 180 are substantially aligned with the primary channels 70 and with the ram axis A. The primary channel offset distance 76 and space between the secondary channel members 130 and the base members 132 allow the bolts 156 and nuts 158 to be inserted through the holes 60 and 150 and assembly of the bolt assemblies 136.

With the first and second adapter assemblies 124 and 126 rigidly connected to the diesel hammer system 20, the web members 160 inhibit movement of the secondary channel members 130 along the ram axis or twisting of the secondary channel members 130 relative to the ram axis A. The lateral braces 162, 164, and 166 engage portions of the diesel hammer system 20, in this case the mounting brackets 42, 44, and 46, respectively, to inhibit lateral or tangential movement of the secondary channel members 130 relative to the ram axis A. The longitudinal braces 170, 172, and 174 inhibit movement of the secondary channel members 130 along the ram axis or twisting of the secondary channel members 130 relative to the ram axis A. The longitudinal braces 170, 172, and 174 further inhibit movement of the lateral braces 162, 164, and 166 in a direction generally along the ram axis A.

Further, with the first and second adapter assemblies 124 and 126 rigidly connected to the diesel hammer system 20, the secondary channel members 130 define a secondary channel offset distance 186 from the outer surface of the ram housing 22. And when both of the first and second adapter assemblies 124 and 126 are rigidly connected to the diesel hammer system 20, the secondary channel channels 180 define a secondary channel spacing distance 188.

Figure 5:
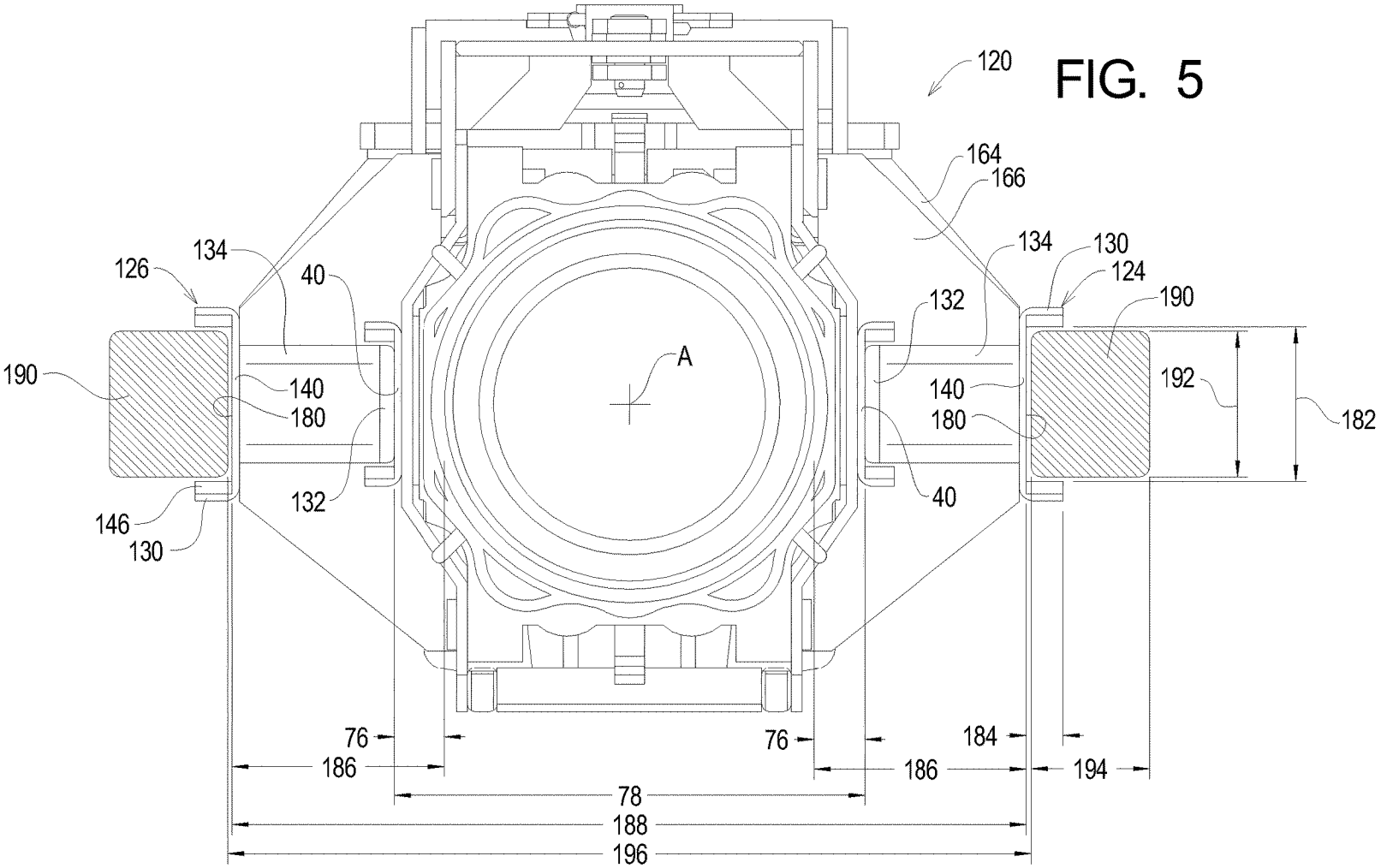
FIG. 5 is a bottom plan view of the second example diesel hammer system.
Figure 6:
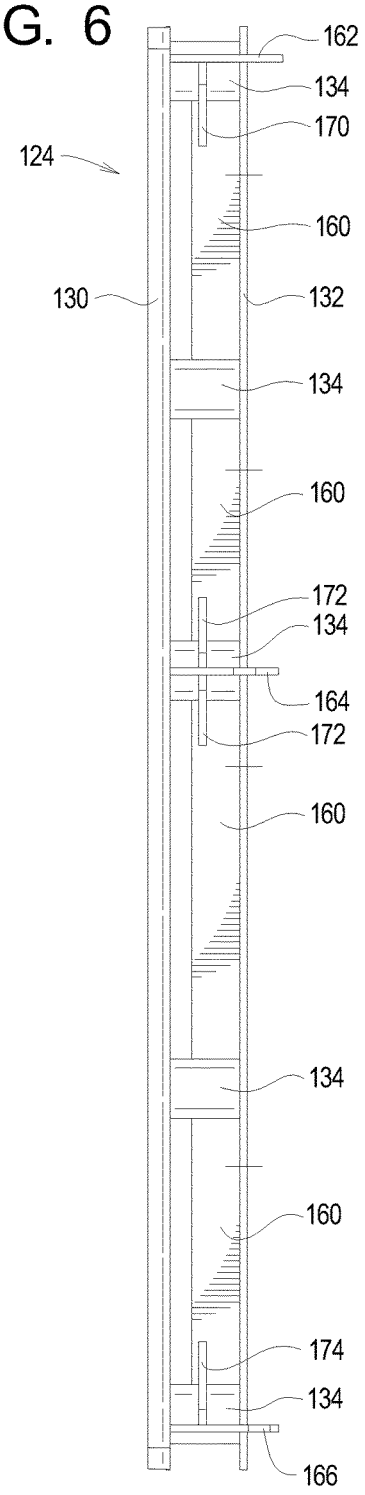
FIG. 6 is a first side elevation view of a first example channel adapter assembly of a first example channel adapter system used by the second example diesel hammer.
Figure 7:
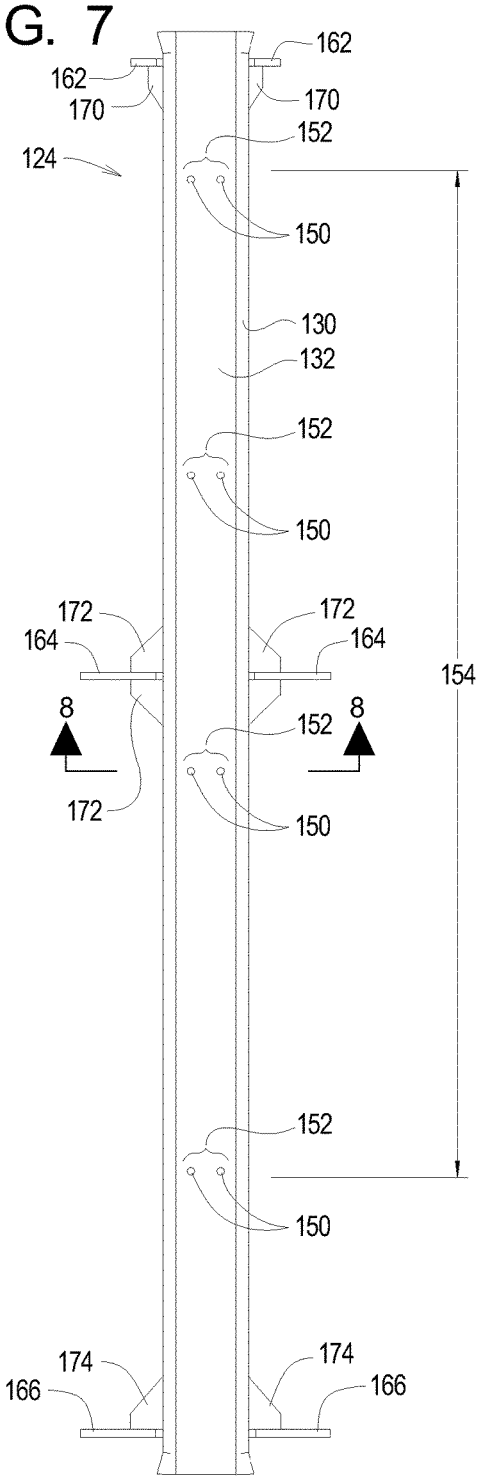
FIG. 7 is a second side elevation view of the first example channel adapter assembly of the first example channel adapter system used by the second example diesel hammer.

FIG. 5 illustrates that a second support member 190 is arranged at least partly within each of the secondary channels 180. The second support members 190 are identical and define a substantially rectangular cross-sectional shape as shown in FIG. 5. Like the example support members 80 described above, the example support members 190 are solid or hollow rigid members that define a second support width 192 and a second support depth 194 and are supported in parallel relative to each other. Further, the second support members 190 are spaced from each other by a second support spacing distance 196.

The second support width 192, second support depth 194, and second support spacing distance 196 will be predetermined for a particular situation. The second support width 192 will determine the secondary channel width 182, the second support depth 194 will determine the secondary channel depth 184, and the second support spacing distance 196 will determine the secondary channel spacing distance 188. In particular, the secondary channel width 182 will be slightly smaller than the second support width 192, the primary channel depth 184 will be sufficient to engage the second support depth 194 dimensions of the support members 190 to allow the support members 190 to engage the primary channel members 130 to hold the diesel hammer system 120 substantially upright or vertical, and the secondary channel spacing distance 188 will be slightly smaller than the second support spacing distance 196.

In use, the support members 190 are sized, dimensioned, and arranged to maintain the diesel hammer system 120 in a substantially upright or vertical orientation during normal operation of the diesel hammer system 120. In particular, the support members 190 will typically be held by a vehicle or crane (not shown) capable of supporting the support members 80 and diesel hammer system 20 in a substantially upright or vertical orientation relative to a desired location at which the pile is to be driven. The vehicle or crane for supporting the support members 80 is or may be conventional and will not be described herein in detail. However, different support systems (e.g., vehicle or crane) may define the second support width 192, the second support depth 194, and the second support spacing distance 196.

The rail adapter system 122 thus allows the diesel hammer system 20 to be converted into the diesel hammer system 120 as appropriate for use with the support members 190 simply by forming the bolt assemblies 136 as described above. The rail adapter system 122 allows the diesel hammer system 120 to be converted back into the diesel hammer system 20 appropriate for use with the support members 80 simply by disassembling the bolt assemblies 136 and removing the first and second channel adapter assemblies 124 and 126.

Figure 10:
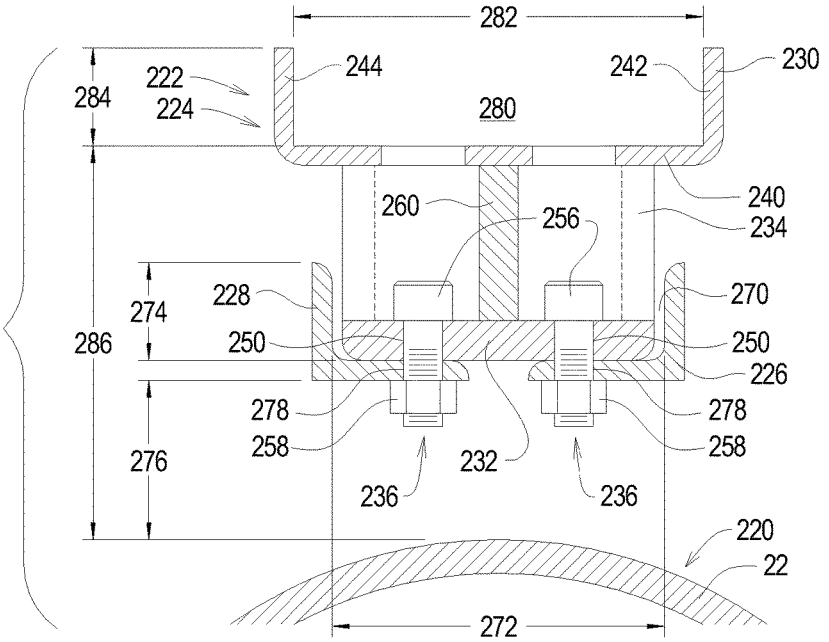
FIG. 10 is a somewhat schematic section view of a portion of a third example diesel hammer using a second example channel adapter assembly.
Figure 11:
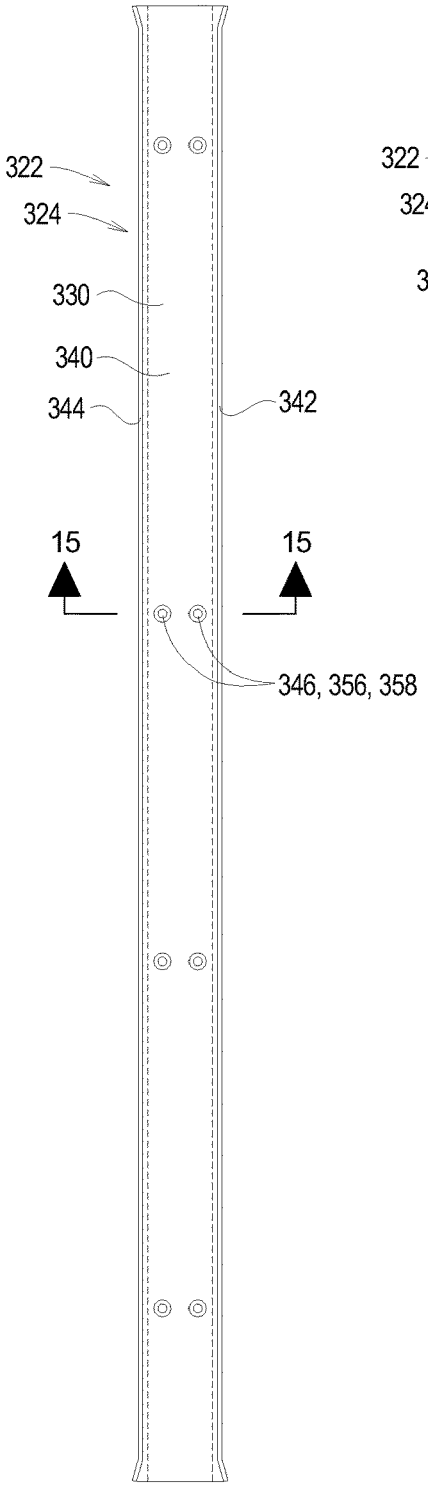
FIG. 11 is a first side elevation view of a fourth example channel adapter assembly of a third example channel adapter system that may be used by a diesel hammer system such as the first and second example diesel hammer systems.
Figure 12:
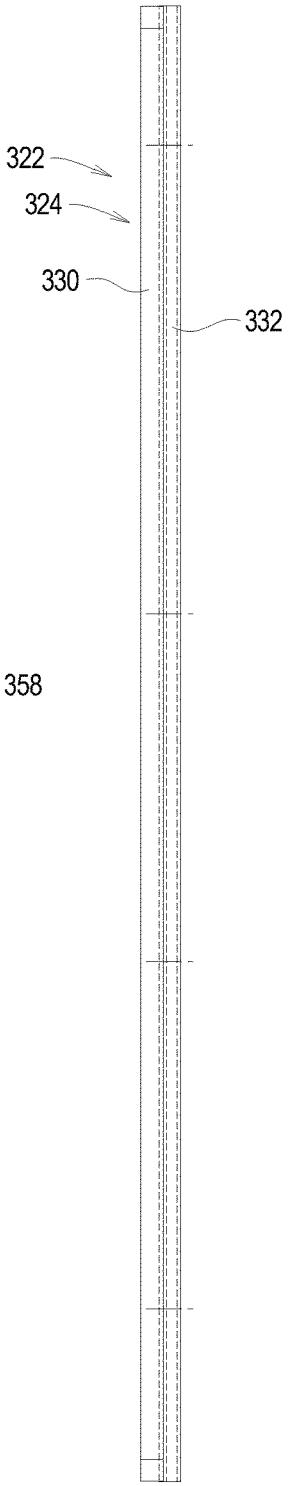
FIG. 12 is a second side elevation view of the fourth example channel adapter assembly.
Figure 13:
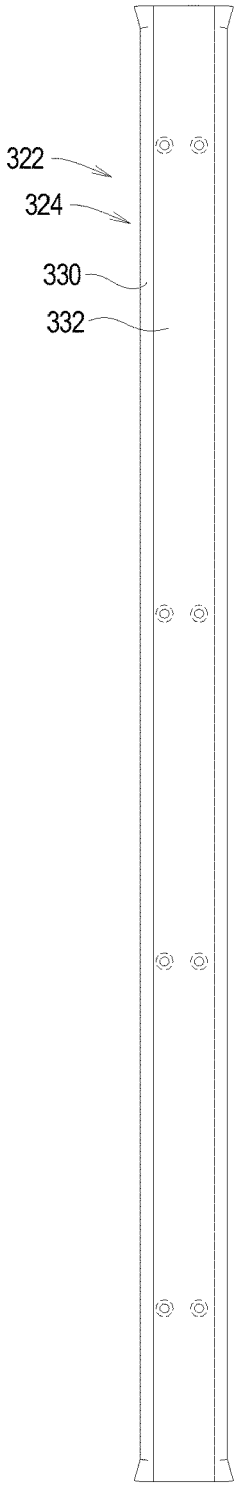
FIG. 13 is a third side elevation view of the fourth example channel adapter assembly.
Figure 14:
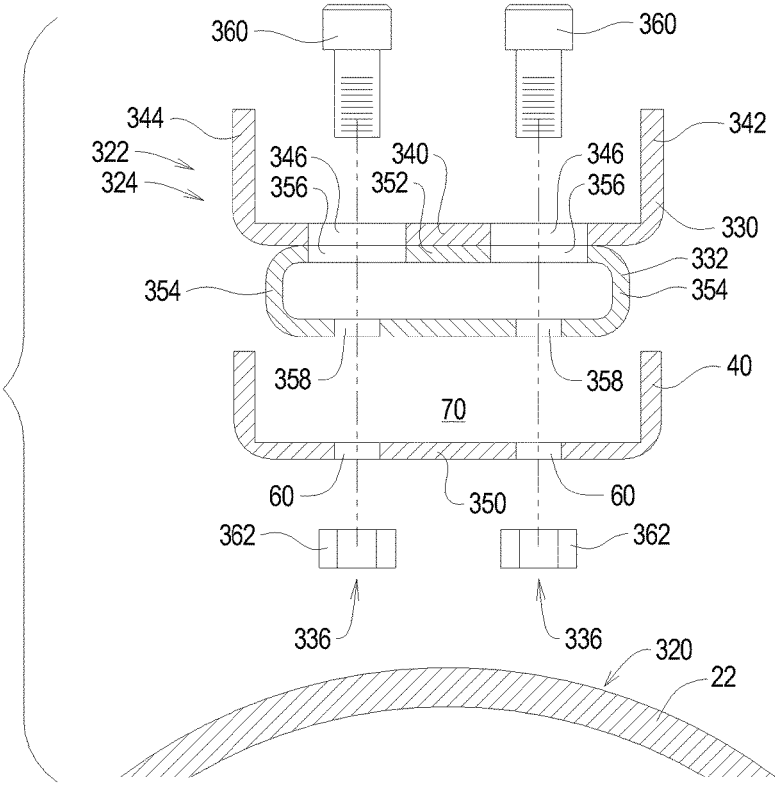
FIG. 14 is a somewhat schematic exploded section view of a portion of the fourth example channel adapter assembly as used with the first example diesel hammer.

FIG. 10 illustrates a portion of a third example diesel hammer system 220 that may be formed using a second example rail adapter system 222 of the present invention. The second example rail adapter system 222 comprises a first channel adapter assembly 224 and a second example rail adapter assembly (not visible in FIG. 10). FIG. 10 further illustrates that, instead of a single U-shaped rigid member forming the primary channel, the third example diesel hammer system 220 comprises a pair (only one pair shown in FIG. 10) of first and second L-shaped rigid members 226 and 228 rigidly secured relative to the ram housing 22.

Each of the example first and second channel adapter assemblies 224 comprises a secondary channel member 230, a base member 232, one or more standoff members 234, and at least one bolt assembly 236. The example secondary channel members 230 are identical and each comprises a main guide wall 240, a first side guide wall 242, and a second side guide wall 244. Secondary mounting holes 250 are formed in the base member 232. The mounting holes 250 are arranged in pairs, and the pairs are grouped to define a secondary hole pattern. The example bolt assembly or assemblies 236 each comprises a bolt 256 and a nut 258. The example standoff members 234 rigidly connect the secondary channel member 230 to the base member 232 such that the main guide wall 240 is substantially parallel to a reference plane defined by the base member 232.

The example first and second channel adapter assemblies 224 further comprise web members 260. While not shown in FIG. 10, lateral and/or longitudinal braces may also be used with the channel adapter assemblies 224. FIG. 10 further illustrates that each pair of the rigid members 226 and 228 defines a primary channel 270 (only one channel visible in FIG. 10). The primary channels 270 each define a primary channel width 272 and a primary channel depth 274. The primary channel members 226 and 228 define a primary channel offset distance 276. As with the primary channels described above, a primary channel spacing distance separates the two primary channels 270. Each of the rigid members 226 and 228 defines a primary mounting hole 278. The example standoff members 234 are shorter than the standoff members 134 and thus define a shorter second channel spacing distance than the secondary channel spacing distance 188 described above.

To form the third diesel hammer system 220, the first and second channel adapter assemblies 224 are arranged such that the base members 232 thereof are each within one of the primary channels 270 with the secondary mounting holes 250 aligned with primary mounting holes 278 formed in the primary channel members 226 and 228. Rotating the nuts 258 relative to the bolts 256 allows the bolt assemblies 236 to be formed, thereby rigidly connecting the base members 232, and thus the first and second adapter assemblies 224, to the primary channel members 226 and 228, and thus to the diesel ram housing 22.

Each secondary channel member 230 defines a secondary channel 280 defining a secondary channel width 282 and a secondary channel depth 284. Each secondary channel member 230 further defines a secondary channel offset distance 286 when secured relative to the diesel housing 22. Further, when secured relative to the diesel housing 22, the secondary channels 280 define a secondary channel spacing distance.

The rail adapter system 222 thus allows the diesel hammer system 20 with the pairs of L-shaped channel members 226 and 228 to be converted into the diesel hammer system 220 as appropriate for use with support members appropriate for the secondary channel spacing distance simply by forming the bolt assemblies 236 as described above. The rail adapter system 222 allows the diesel hammer system 220 to be converted back into the diesel hammer system 20 appropriate for use with the support members 80 simply by disassembling the bolt assemblies 236 and removing the first and second channel adapter assemblies 224.

FIGS. 11-15 illustrate portions of a fourth example diesel hammer system 320 comprising a third example rail adapter system 322. The fourth example diesel hammer system 320 incorporates the example diesel hammer system 20 comprising the primary channel members 40 as described above. The third example rail adapter system 322 comprises first and second channel adapter assemblies 324 (only one visible in FIGS. 11-15).

Each of the example first and second channel adapter assemblies 324 comprises a secondary channel member 330, a base member 332, and at least one bolt assembly 336. The example secondary channel members 330 are identical and each comprises a main guide wall 340, a first side guide wall 342, and a second side guide wall 344. Main access openings 346 are formed in the main guide wall 340. The example base member 332 is a hollow structure defining a base wall 350, a spaced wall 352, and standoff walls 354. Secondary access openings 356 are formed in the spaced wall 352, while secondary mounting holes 358 are formed in the base wall 350. The mounting holes 358 are arranged in pairs, and the pairs are grouped to define a secondary hole pattern. On each of the access openings 346 and 356 are arranged adjacent to each mounting hole 358. The example bolt assembly or assemblies 336 each comprises a bolt 360 and a nut 362.

Figure 15:
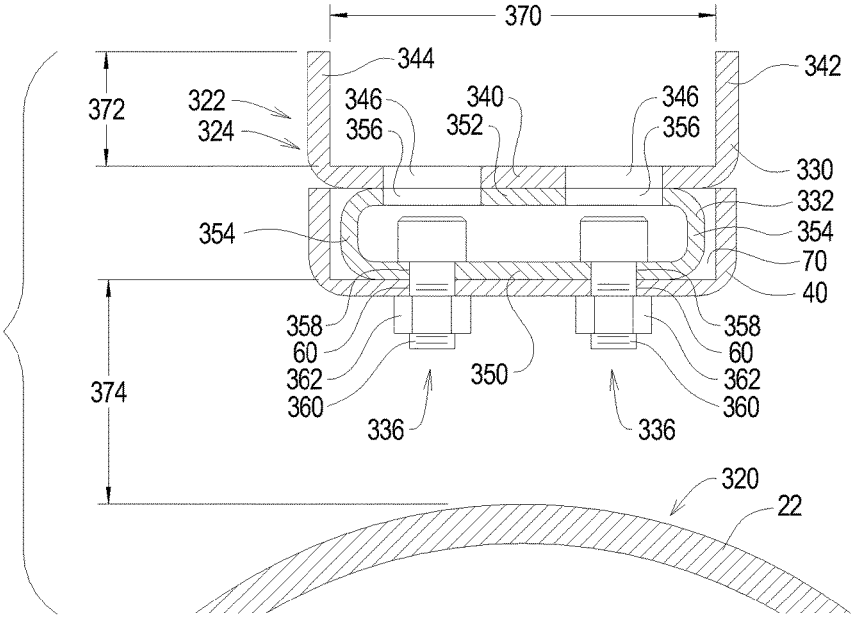
FIG. 15 is a somewhat schematic section view of a portion of the fourth example channel adapter assembly as used with the first example diesel hammer.
Figure 16:
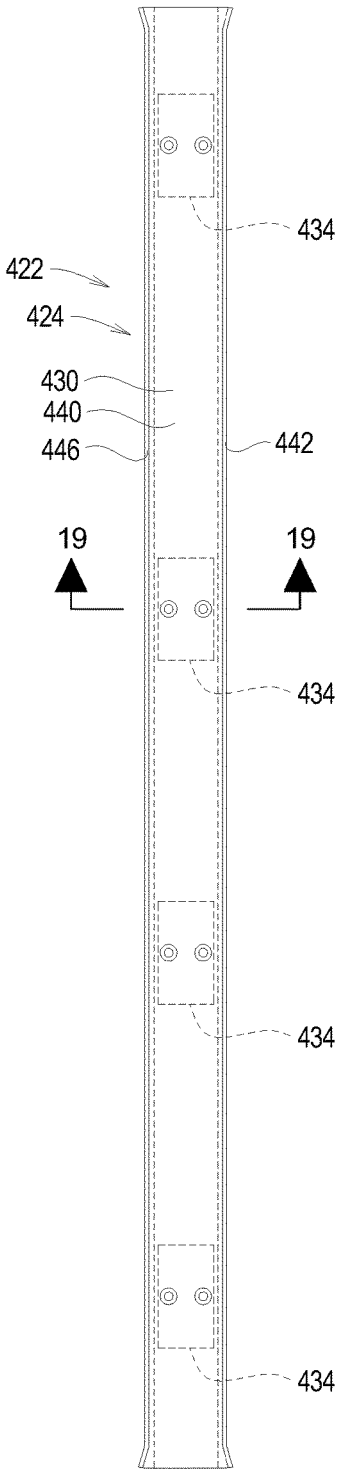
FIG. 16 is a first side elevation view of a fifth example channel adapter assembly of a fourth example channel adapter system that may be used by a diesel hammer system such as the first and second example diesel hammer systems.
Figure 17:
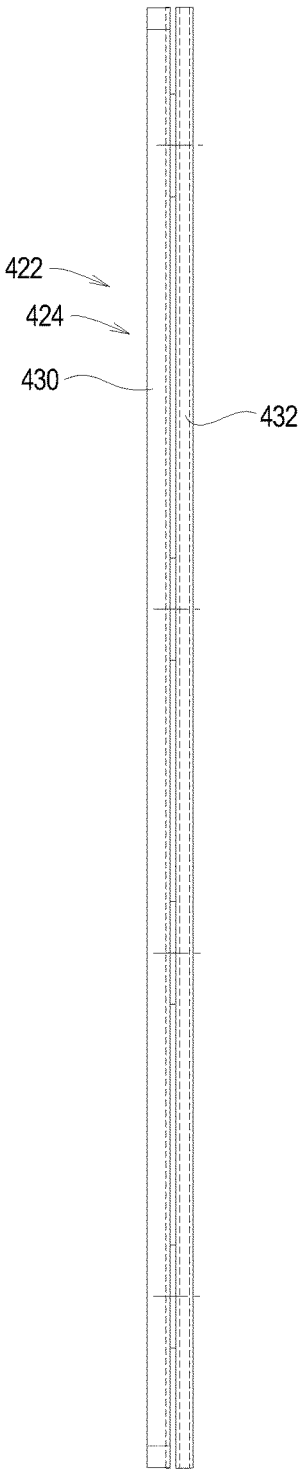
FIG. 17 is a second side elevation view of the fifth example channel adapter assembly.
Figure 18:
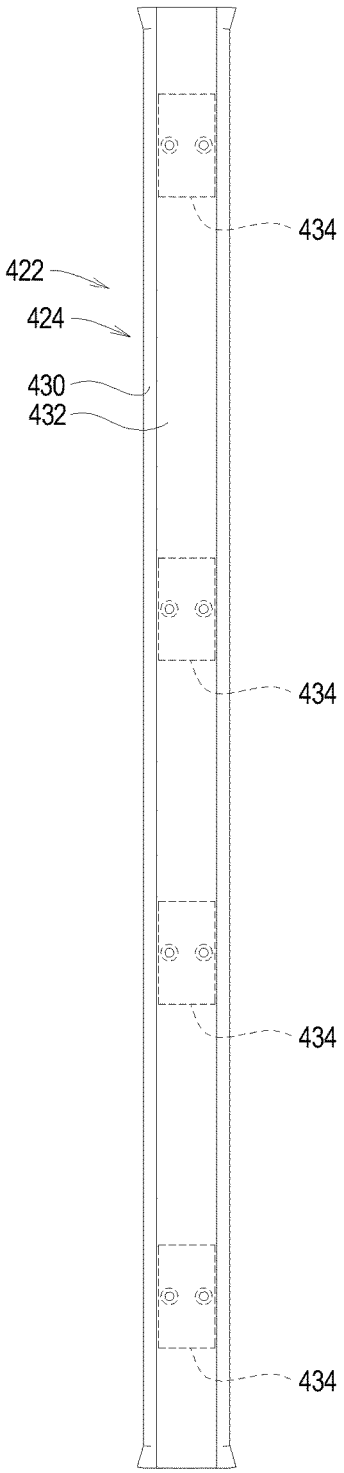
FIG. 18 is a third side elevation view of the fifth example channel adapter assembly.

To form the fourth diesel hammer system 320, the first and second channel adapter assemblies 324 are arranged such that the base members 332 thereof are each within one of the primary channels 70 with the secondary mounting holes 358 aligned with primary mounting holes 60 formed in the primary channel member 40. The bolts 360 are inserted into the secondary mounting holes 358 by first passing through the access openings 346 and 356. With the bolts 360 in place as shown in FIG. 15, rotating the nuts 362 relative to the bolts 360 allows the bolt assemblies 336 to be formed, thereby rigidly connecting the base members 332, and thus the first and second adapter assemblies 324, to the primary channel members 40, and thus to the diesel housing 22.

Each secondary channel member 330 defines a secondary channel width 370, a secondary channel depth 372, a secondary channel offset distance 374 when secured relative to the diesel housing 22. Further, when secured relative to the diesel housing 22, the secondary channels 330 define a secondary channel spacing distance.

The rail adapter system 322 thus allows the diesel hammer system 20 to be converted into the diesel hammer system 320 as appropriate for use with support members appropriate for the secondary channel spacing distance defined by the secondary channel members 330 simply by forming the bolt assemblies 336 as described above. The rail adapter system 322 allows the diesel hammer system 320 to be converted back into the diesel hammer system 20 appropriate for use with the support members 80 simply by disassembling the bolt assemblies 336 and removing the first and second channel adapter assemblies 324.

FIGS. 16-19 illustrate portions of a fifth example diesel hammer system 420 comprising a fourth example rail adapter system 422. The fifth example diesel hammer system 420 incorporates the example diesel hammer system 20 comprising the primary channel members 40 as described above. The fourth example rail adapter system 422 comprises first and second channel adapter assemblies 424 (only one visible in FIGS. 16-19).

Each of the example first and second channel adapter assemblies 424 comprises a secondary channel member 430, a base member 432, a spacing member 434, and at least one bolt assembly 436. The example secondary channel members 430 are identical and each comprises a main guide wall 440, a first side guide wall 442, and a second side guide wall 444. Main access openings 446 are formed in the main guide wall 440. The spacing member 434 is simply a rigid plate rigidly connected between the secondary channel member 430 and the base member 432 and defines a plate access opening 448. The example base member 432 is a hollow structure defining a base wall 450, a spaced wall 452, and standoff walls 454. Secondary access openings 456 are formed in the spaced wall 452, while secondary mounting holes 458 are formed in the base wall 450. The mounting holes 458 are arranged in pairs, and the pairs are grouped to define a secondary hole pattern. One each of the access openings 446, 448, and 456 are arranged adjacent to each of the mounting holes 458. The example bolt assembly or assemblies 436 each comprises a bolt 460 and a nut 462.

Figure 19:
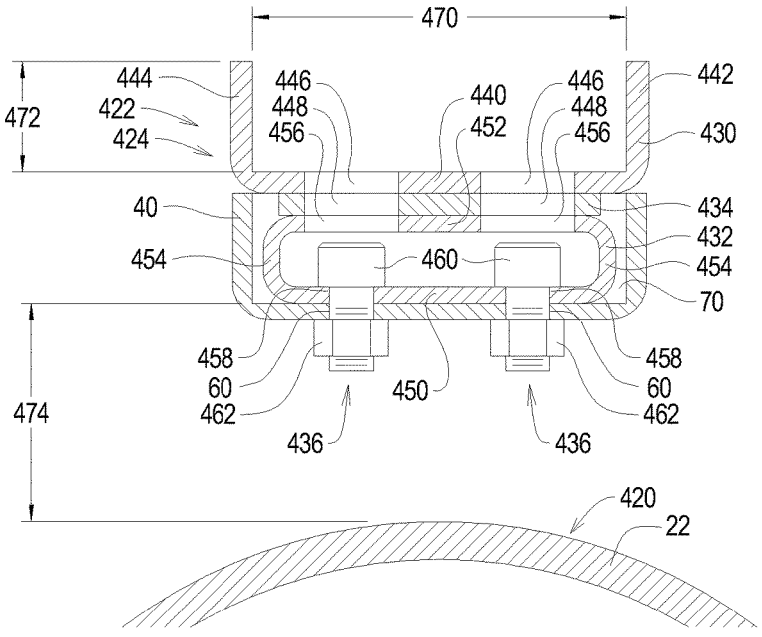
FIG. 19 is a somewhat schematic section view of a portion of the fifth example channel adapter assembly as used with the first example diesel hammer.

To form the fifth diesel hammer system 420, the first and second channel adapter assemblies 424 are arranged such that the base members 432 thereof are each within one of the primary channels 70 with the secondary mounting holes 458 aligned with primary mounting holes 60 formed in the primary channel member 40. The bolts 460 are inserted into the primary mounting holes 458 by first passing through the access openings 446, 448, and 456. With the bolts 460 in place as shown in FIG. 19, rotating the nuts 462 relative to the bolts 460 allows the bolt assemblies 436 to be formed, thereby rigidly connecting the base members 432, and thus the first and second adapter assemblies 424, to the primary channel members 40, and thus to the diesel housing 22.

Each secondary channel member 430 defines a secondary channel width 470, a secondary channel depth 472, a secondary channel offset distance 474 when secured relative to the diesel housing 22. Further, when secured relative to the diesel housing 22, the secondary channels 430 define a secondary channel spacing distance.

The rail adapter system 422 thus allows the diesel hammer system 20 to be converted into the diesel hammer system 420 as appropriate for use with support members appropriate for the secondary channel spacing distance defined by the secondary channel members 430 simply by forming the bolt assemblies 436 as described above. The rail adapter system 422 allows the diesel hammer system 420 to be converted back into the diesel hammer system 20 appropriate for use with the support members 80 simply by disassembling the bolt assemblies 436 and removing the first and second channel adapter assemblies 424.

Figure 20:
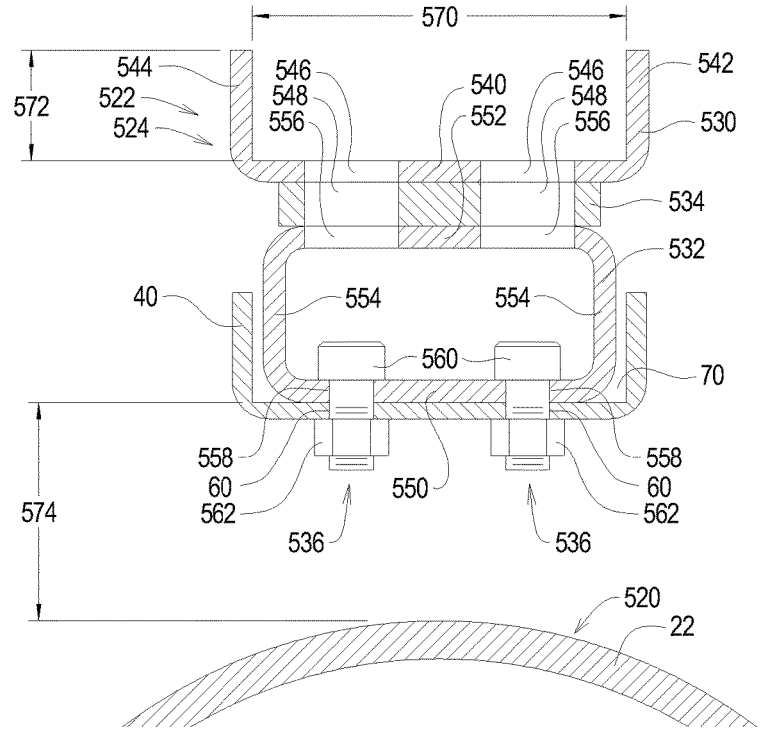
FIG. 20 is a somewhat schematic section view of a portion of a sixth example diesel hammer system employing a fifth example channel adapter assembly.

FIG. 20 illustrates a portions of a sixth example diesel hammer system 520 comprising a fifth example rail adapter system 522. The sixth example diesel hammer system 520 incorporates the example diesel hammer system 20 comprising the primary channel members 40 as described above. The fifth example rail adapter system 522 comprises first and second channel adapter assemblies 524 (only one visible in FIG. 20).

Each of the example first and second channel adapter assemblies 524 comprises a secondary channel member 530, a base member 532, a spacing member 534, and at least one bolt assembly 536. The example secondary channel members 530 are identical and each comprises a main guide wall 540, a first side guide wall 542, and a second side guide wall 544. Main access openings 546 are formed in the main guide wall 540. The spacing member 534 is simply a rigid plate rigidly connected between the secondary channel member 530 and the base member 532 and defines a plate access opening 548. The example base member 532 is a hollow structure defining a base wall 550, a spaced wall 552, and standoff walls 554. Secondary access openings 556 are formed in the spaced wall 552, while secondary mounting holes 558 are formed in the base wall 550. The mounting holes 558 are arranged in pairs, and the pairs are grouped to define a secondary hole pattern. One each of the access openings 546, 548, and 556 are arranged adjacent to each of the mounting holes 558. The example bolt assembly or assemblies 536 each comprises a bolt 560 and a nut 562.

To form the sixth diesel hammer system 520, the first and second channel adapter assemblies 524 are arranged such that the base members 532 thereof are each within one of the primary channels 70 with the secondary mounting holes 558 aligned with primary mounting holes 60 formed in the primary channel member 40. The bolts 560 are inserted into the primary mounting holes 558 by first passing through the access openings 546, 548, and 556. With the bolts 560 in place as shown in FIG. 20, rotating the nuts 562 relative to the bolts 560 allows the bolt assemblies 536 to be formed, thereby rigidly connecting the base members 532, and thus the first and second adapter assemblies 524, to the primary channel members 40, and thus to the diesel housing 22.

Each secondary channel member 530 defines a secondary channel width 570, a secondary channel depth 572, a secondary channel offset distance 574 when secured relative to the diesel housing 22. Further, when secured relative to the diesel housing 22, the secondary channels 530 define a secondary channel spacing distance.

The rail adapter system 522 thus allows the diesel hammer system 20 to be converted into the diesel hammer system 520 as appropriate for use with support members appropriate for the secondary channel spacing distance defined by the secondary channel members 530 simply by forming the bolt assemblies 536 as described above. The rail adapter system 522 allows the diesel hammer system 520 to be converted back into the diesel hammer system 20 appropriate for use with the support members 80 simply by disassembling the bolt assemblies 536 and removing the first and second channel adapter assemblies 524.

As can be seen by a comparison of FIGS. 19 and 20, the structure of the first and second channel adapter assemblies 524 is similar to that of the first and second channel adapter assemblies 424 described above. However, by appropriate selection of geometry of the base members 432,532 and spacing members 434,534, different channel offset distances and secondary channel spacing distances can be obtained for a particular set of support members similar to, but with different geometry than, the example support members 80 and 190 described above.

What is claimed is:

1. A guide system for allowing a diesel hammer to be supported by a plurality of support systems, the guide system comprising:

a primary channel system rigidly connected to the diesel hammer to define
a pair of primary channels, and
a primary spacing distance between the primary channels;
a pair of first channel adapter assemblies each defining a first secondary channel; wherein
the guide system operates
in a first configuration in which portions of a first support system of the plurality of support systems are received within the primary channels, and
in a second configuration in which
each of the first channel adapter assemblies is detachably attached to the primary channel system such that the first channel adapter assemblies define a first secondary spacing distance between the first secondary channels,
the first secondary spacing distance is different from the primary spacing distance, and
portions of a second support system of the plurality of support systems are received within the first secondary channels.

2. A guide system as recited in claim 1, further comprising a plurality of connecting assemblies, in which the plurality of connecting assemblies are arranged to detachably attach the first channel adapter assemblies to the primary channel system.

3. A guide system as recited in claim 2, in which the primary channel system is rigidly connected to the diesel hammer to define a primary offset distance, where the primary offset distance is predetermined to allow assembly of the plurality of connecting assemblies.

4. A guide system as recited in claim 1, further comprising:
a pair of second channel adapter assemblies each defining a second secondary channel; wherein
the guide system further operates in a third configuration in which each of the second channel adapter assemblies is detachably attached to one of the primary guide members such that the second channel adapter assemblies define a second secondary spacing distance between the second secondary channels,
the second secondary spacing distance is different from the primary spacing distance and from the first secondary spacing distance, and
portions of a third support system of the plurality of support systems are received within the second secondary channels.

5. A guide system as recited in claim 4, further comprising at least one bolt assembly, in which:
the primary channel system comprises first and second guide members,
where each guide member defines
one of the primary channels, and
at least one primary mounting hole; and
each first channel adapter assembly comprises:
a first secondary channel member;
a first base member defining at least one first secondary mounting hole; and
at least one first standoff member rigidly connected between the first base member and the first secondary channel member;
each second channel adapter assembly comprises:
a second secondary channel member;
a second base member defining at least one second secondary mounting hole; and
at least one second standoff member rigidly connected between the second base member and the second secondary channel member; wherein
in the second configuration,
each first secondary mounting hole is aligned with one primary mounting hole;
the at least one bolt assembly is extended through each aligned primary mounting hole and first secondary mounting hole; and
at least a portion of the at least one bolt assembly is arranged between the first base member and the first secondary channel member;
in the third configuration,
each second secondary mounting hole is aligned with one primary mounting hole;
the at least one bolt assembly is extended through each aligned primary mounting hole and second secondary mounting hole; and
at least a portion of the at least one bolt assembly is arranged between the second base member and the second secondary channel member.

6. A guide system as recited in claim 1, further comprising at least one bolt assembly, in which:
the primary channel system comprises first and second guide members,
where each guide member defines
one of the primary channels, and
at least one primary mounting hole; and
each first channel adapter assembly comprises:
a first secondary channel member
a base member defining a first secondary mounting hole, and
at least one standoff member rigidly connected between the base member and the secondary channel member; wherein
in the second configuration,
each first secondary mounting hole is aligned with one primary mounting hole;
the at least one bolt assembly is extended through each aligned primary mounting hole and secondary mounting hole; and
at least a portion of the at least one bolt assembly is arranged between the base member and the first secondary channel member.

7. A method of supporting a diesel hammer from a plurality of support systems comprising the steps of:
rigidly connecting a primary channel system to the diesel hammer to define
a pair of primary channels, and
a primary spacing distance between the primary channels;
providing a pair of first channel adapter assemblies each defining a first secondary channel;
operating
in a first configuration in which portions of a first support system of the plurality of support systems are received within the primary channels, and
in a second configuration in which
each of the first channel adapter assemblies is detachably attached to the primary channel system such that the first channel adapter assemblies define a first secondary spacing distance between the first secondary channels,
the first secondary spacing distance is different from the primary spacing distance, and portions of a second support system of the plurality of support systems are received within the first secondary channels.

8. A method as recited in claim 7, further comprising the step of arranging a plurality of connecting assemblies to detachably attach the first channel adapter assemblies to the primary channel system.

9. A method as recited in claim 8, further comprising the steps of:

predetermining a primary offset distance between sufficient to allow assembly of the plurality of connecting assemblies; and rigidly connecting the primary channel system to the diesel hammer to define the primary offset distance.

10. A method as recited in claim 7, further comprising the steps of:

providing a pair of second channel adapter assemblies each defining a second secondary channel; and operating in a third configuration in which each of the second channel adapter assemblies is detachably attached to one of the primary guide members such that the second channel adapter assemblies define a second secondary spacing distance between the second secondary channels, the second secondary spacing distance is different from the primary spacing distance and from the first secondary spacing distance, and portions of a third support system of the plurality of support systems are received within the second secondary channels.

11. A method as recited in claim 10, in which:

the step of rigidly connecting the primary channel system to the diesel hammer comprises the steps of providing first and second guide members, where each guide member defines one of the primary channels, and at least one primary mounting hole; and rigidly connecting the first and second guide members to the diesel hammer;

the step of providing the first channel adapter assemblies comprises the steps of providing a first secondary channel member;

providing a first base member defining at least one first secondary mounting hole; and rigidly connecting at least one first standoff member between the first base member and the first secondary channel member;

the step of providing the second channel adapter assemblies comprises the steps of providing a second secondary channel member;

providing a second base member defining at least one second secondary mounting hole; and rigidly connecting at least one second standoff member between the second base member and the second secondary channel member; wherein in the second configuration, each first secondary mounting hole is aligned with one primary mounting hole;

at least one bolt assembly is extended through each aligned primary mounting hole and first secondary mounting hole; and at least a portion of the at least one bolt assembly is arranged between the first base member and the first secondary channel member.

in the third configuration, each second secondary mounting hole is aligned with one primary mounting hole;

at least one bolt assembly is extended through each aligned primary mounting hole and second secondary mounting hole; and at least a portion of the at least one bolt assembly is arranged between the second base member and the second secondary channel member.

12. A method as recited in claim 7, in which:

the step of rigidly connecting the primary channel system to the diesel hammer comprises the steps of providing first and second guide members, where each guide member defines one of the primary channels, and at least one primary mounting hole, and rigidly connecting the first and second guide members to the diesel hammer; and the step of providing the first channel adapter assemblies comprises the steps of providing a first secondary channel member;

providing a base member defining a first secondary mounting hole;

rigidly connecting at least one standoff member between the base member and the secondary channel member; wherein in the second configuration, each first secondary mounting hole is aligned with one primary mounting hole;

the at least one bolt assembly is extended through each aligned primary mounting hole and secondary mounting hole; and at least a portion of the at least one bolt assembly is arranged between the base member and the first secondary channel member.

13. A guide system for allowing a diesel hammer to be supported by first, second, and third support systems, the guide system comprising:

a primary channel system rigidly connected to the diesel hammer to define a pair of primary channels, a primary spacing distance between the primary channels;

a pair of first channel adapter assemblies each defining a first secondary channel; and a pair of second channel adapter assemblies each defining a second secondary channel; wherein the guide system operates in a first configuration in which portions of the first support system are received within the primary channels, in a second configuration in which each of the first secondary channel adapter assemblies is detachably attached to the primary channel system such that the first channel adapter assemblies define a first secondary spacing distance between the first secondary channels, the first secondary spacing distance is different from the primary spacing distance, and portions of the second support system are received within the first secondary channels, and in a third configuration in which each of the second channel adapter assemblies is detachably attached to the primary channel system such that the second channel adapter assemblies define a second secondary spacing distance between the first secondary channels, the second secondary spacing distance is different from the primary spacing distance and the first secondary spacing distance, and portions of the third support system are received within the second secondary channels.

14. A guide system as recited in claim 13, further comprising a plurality of connecting assemblies, in which the plurality of connecting assemblies are arranged to detachably attach the first channel adapter assemblies to the primary channel system.

15. A guide system as recited in claim 14, in which the primary channel system is rigidly connected to the diesel hammer to define a primary offset distance, where the primary offset distance is predetermined to allow assembly of the plurality of connecting assemblies.

16. A guide system as recited in claim 13, further comprising at least one bolt assembly, in which:

the primary channel system comprises first and second guide members, where each guide member defines one of the primary channels, and at least one primary mounting hole; and each first channel adapter assembly comprises:

a first secondary channel member;

a first base member defining at least one first secondary mounting hole; and at least one first standoff member rigidly connected between the first base member and the first secondary channel member;

each second channel adapter assembly comprises:

a second secondary channel member;

a second base member defining at least one second secondary mounting hole; and at least one second standoff member rigidly connected between the second base member and the second secondary channel member; wherein in the second configuration, each first secondary mounting hole is aligned with one primary mounting hole;

the at least one bolt assembly is extended through each aligned primary mounting hole and first secondary mounting hole; and at least a portion of the at least one bolt assembly is arranged between the first base member and the first secondary channel member;

in the third configuration, each second secondary mounting hole is aligned with one primary mounting hole;

the at least one bolt assembly is extended through each aligned primary mounting hole and second secondary mounting hole; and at least a portion of the at least one bolt assembly is arranged between the second base member and the second secondary channel member.

* * * * *